US005128851A

United States Patent [19]

Kosmatka et al.

[11] Patent Number: 5,128,851

[45] Date of Patent: Jul. 7, 1992

[54] VIBRATION RESISTANT MOUNT STRUCTURE FOR DOUBLE ENDED TUNGSTEN-HALOGEN LAMP

[75] Inventors: Walter J. Kosmatka, Highland Heights; Brian R. Swiers, Berea; James M. Hanson, Euclid, all of Ohio

[73] Assignee: General Electric Company, Schenectady, N.Y.

[21] Appl. No.: 452,489

[22] Filed: Dec. 19, 1989

[51] Int. Cl.[5] ..... F21V 15/04

[52] U.S. Cl. ..... 362/390; 362/306; 362/369

[58] Field of Search ..... 362/306, 390, 363, 369; 313/25, 113, 269; 439/382, 383, 384, 385

[56] References Cited

U.S. PATENT DOCUMENTS

| | | | |
|---|---|---|---|
| 2,004,610 | 6/1935 | Jones | 439/382 |
| 2,247,409 | 7/1941 | Roper | 313/113 |
| 3,327,110 | 6/1967 | Baldwin | 362/390 X |
| 3,579,020 | 5/1971 | Cullen | 313/269 |
| 3,688,149 | 8/1972 | Pitkjaan | 313/113 |
| 4,282,566 | 8/1981 | Newman | 362/390 X |
| 4,437,145 | 3/1984 | Roller et al. | 362/306 |
| 4,463,276 | 9/1983 | Blaisdell | 362/306 |
| 4,470,104 | 9/1984 | Cox | 313/113 |
| 4,507,712 | 7/1985 | Dolan et al. | 362/306 X |
| 4,810,932 | 3/1984 | Ahlgreen et al. | 313/374 |
| 4,922,395 | 5/1990 | Roney | 362/306 |
| 4,935,668 | 6/1990 | Hansler et al. | 313/113 |
| 4,987,343 | 1/1991 | Kosmatka et al. | 313/113 |

*Primary Examiner*—Ira S. Lazarus
*Assistant Examiner*—Y. Quach
*Attorney, Agent, or Firm*—George E. Hawranko; Stanley C. Corwin; Fred Jacob

[57] ABSTRACT

A mount structure for a double ended type tungsten-halogen lamp is disclosed employing vibration damping elements to reduce the effects of mechanical shock and vibration. A thin layer of ceramic cement is interposed between the mount structure and lamp to improve the sealing arrangement related to a quartz lamp. A sealed beam headlamp unit employing the improved lamp mount construction is also disclosed.

16 Claims, 2 Drawing Sheets

Fig. 1
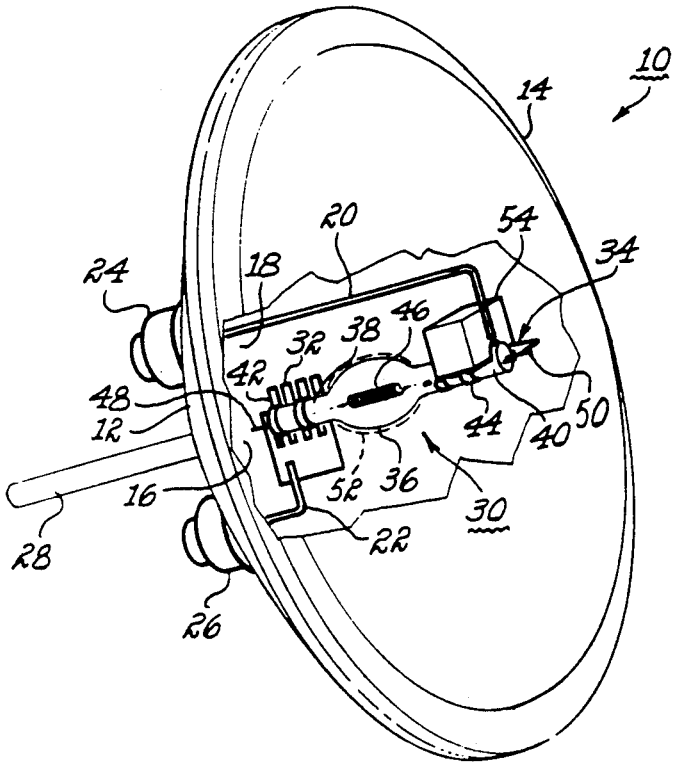
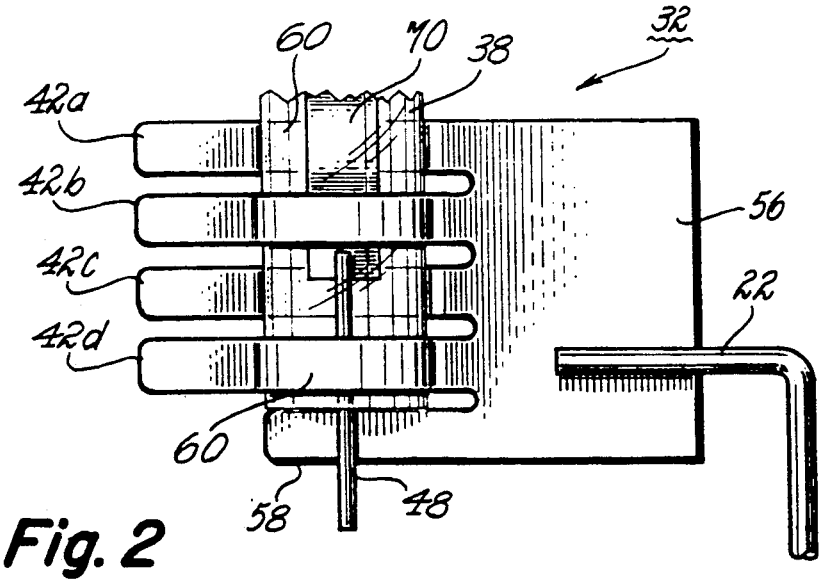
Fig. 2

VIBRATION RESISTANT MOUNT STRUCTURE FOR DOUBLE ENDED TUNGSTEN-HALOGEN LAMP

BACKGROUND OF THE INVENTION

This invention relates generally to more vibration resistant support means for a double ended tungsten-halogen lamp and more particularly to an improved mount structure for such type lamp in various reflector lamps.

Reflector lamp units of various types which employ a double ended tungsten-halogen lamp as the light source enjoy wide spread commercial use in many applications including vehicle and general service lighting applications. In one such type lamp unit, a parabolic aluminized reflector (PAR) member is employed which cooperates with the light source of the lamp unit to project illumination forwardly in an efficient manner. In a different reflector lamp unit of the sealed beam type now used widely in automotive vehicles, aircraft and boats, the aforementioned light source is similarly positioned substantially at the focal point of the reflector member with the lamp unit further including a lens or cover member being secured to the reflector. Such latter type lamp unit generally has the light source aligned substantially along the main or longitudinal lamp unit axis with the further axially aligned tungsten filament in the light source being similarly positioned along the axis.

Various type tungsten-halogen lamps can also be employed as the light source in the aforementioned reflector lamp unit constructions. For example, the lamp construction can employ a vitreous lamp envelope formed with fused quartz but which generally further requires that the lead wires supporting the lamp filament be hermetically sealed within the lamp envelope with thin refractory metal foil elements. Alternately, various glass-halogen lamp constructions can be employed wherein the vitreous lamp envelope is formed with a refractory glass, such as an aluminosilicate glass composition, and which differs structurally from a quartz-halogen lamp primarily with respect to the means employed to hermetically seal the filament lead wires to the lamp envelope. In this regard, a closer match in thermal expansion between the selected glass material and molybdenum metal, generally employed to form said filament lead wires, enables elimination of the foil elements conventionally employed for a hermetic seal in the quartz-halogen lamp construction. Both quartz-halogen and glass-halogen lamps further include a fill of rare gas, such as argon, xenon and krypton, together with a vaporizable halogen compound, such as an alkyl halide substance, also being contained within the lamp envelope. The lamp fill is generally employed at substantially superatmospheric pressure in order to improve lamp efficiency at higher operating temperatures.

A typical sealed beam headlamp construction utilizing a tungsten-halogen lamp for its light source is still further disclosed in U.S. Pat. No. 4,810,932, which is assigned to the assignee of the present invention. As therein disclosed, the double ended lamp is physically supported within the reflector member with support means being physically attached to relatively thin filament lead wires. Connection of the external supporting leads to relatively stiff post members sealed at the rear base portion of the reflector member makes the mounted lamp prone to mechanical failure of the support means based on a number of considerations. Having the support leads less rigid than the post terminals produces a vibrational resonant frequency for the overall mount construction which now resides in a range commonly encountered during vehicle operation. Moreover, flexure of such mount construction under vibration and mechanical shock becomes concentrated at the still smaller cross section filament lead wires being employed. Since the smaller size filament lead wires are commonly joined to the supporting lead with significant heating, such as welding or brazing, there can also be significant metallurgical degradation produced at or near to these points of greatest flexure. It can be expected under these circumstances that such prior art lamp becomes thereby prone to mechanical failure from eventual fatigue or rupture of the protruding filament lead wires over a period of time dependent upon such additional factors as mass of the suspended inner lamp, thermal history of the filament lead construction and severity of the external vibration forces being encountered by the lamp unit.

While not depicted in the above described prior art sealed beam headlamp unit, it is also common practice to include metalic heat and/or light shield elements in the lamp construction. These elements are usually crimped along the inner lamp envelope during manufacture and often become disengaged thereafter due to mechanical vibrations being experienced with the lamp unit during use. A still different light shield means currently in commercial use employs a black color coating which is deposited over a portion of the inner lamp envelope. Precisely located this coating has proven difficult to achieve during lamp manufacture and any mislocation of the coating detrimentally effects the lamp performance. An additional problem now encountered by the lamp manufacturer with such coating is satisfactory outgassing of the coating material since both appearance and performance defects can occur in the assembled lamp unit if not properly carried out.

Accordingly, one object of the present invention is to increase the vibration resistance of a mount construction for a double ended tungsten-halogen lamp.

Another object of the invention is to provide a more vibration resistant mount construction for a double ended tungsten-halogen lamp which enables both physical support and electrical connection of the suspended lamp to be made in a simpler manner.

Further still, it is an object of the present invention to provide means to improve the sealing of the members of the tungsten-halogen lamp.

A still further object of the present invention is to provide a mount structure for a double ended tungsten-halogen lamp which employs novel vibration damping elements as the means whereby physical support, electrical connection and light shielding of the lamp is achieved.

Still another object of the invention is to provide more vibration resistant reflector lamp units employing a double ended tungsten-halogen lamp as the light source.

These and still further objects of the present invention will become apparent upon considering the following detailed description for the present invention.

SUMMARY OF THE INVENTION

An improved mount structure has now been discovered to suspend a double ended tungsten-halogen lamp in various type lamp units imparting additional vibration resistance by damping the transmitted vibration of the lamp support means and by raising the resonant frequencies of vibration above that being normally encountered especially in the automotive field. More particularly, the lamp unit construction employs novel vibration damping elements physically interconnecting each protruding filament lead wire of the suspended lamp to rigid terminal means provided in the lamp unit. In doing so, each vibration damping element is structurally configured with a planar body portion that is electrically conductive so as to electrically connect filament lead wires physically joined thereto with further physically interconnected lamp terminal means. Representative vibration damping elements can be formed with various electrically conductive flexible materials to include thermally durable non-metals such as synthetic organic polymers which are metal-filled or have metallic conductor means embedded therein as well as spring-like sheet metals, such as stainless steel and spring bronze. A typical vibration damping element fabricated with electrically conductive thermally durable spring-like metal can be stamped and formed in a conventional manner from a sheet of the material to include finger or tab projections protruding from the planar body portion which enables the aforementioned physical and electrical connections to be made. For example, a suitable vibration damping element constructed in this manner can have a plurality of projecting support tabs formed in the body portion to partially encircle and physically grip, in a spring-like manner, a seal region of the lamp envelope while another projecting tab enables electrical connection, such as by welding or brazing, to the filament lead wire projecting from said seal region. Similarly, a representative vibration damping element of the present invention can have forwardly projecting tabs at one end body portion which physically engage a seal region of the lamp envelope while having a rearwardly projecting tab located at the opposite end of said body portion for direct physical joinder to a rigid terminal component of the lamp unit such as a stiff post member. Both illustrated constructions can further include light shield means extending outwardly from the planar body section and with such modification being generally limited to but one of the cooperating vibration damping elements being employed in the present lamp mount structure, all as further explained in connection with the preferred embodiments hereinafter described. Having the above described vibration damping elements interposed between the lamp envelope and post terminals at each end of the lamp envelope enables the entire mount structure to move as an integral unit rather than unduly flexing the lamp filament lead wires while further exercising a desirable opposing spring force action when so joined to the lamp envelope. The invention further includes the placement of a thin layer of ceramic cement between the mount structure and a lamp envelope formed of quartz so as to improve the sealing of the members of the lamp and to act as a thermal coupling for the purpose of removing heat from the seal portion at the tubular lamp neck.

Basically, a reflector lamp unit according to the present invention comprises (a) an outer concave reflector member having rigid terminal means projecting from the base portion thereof, (b) an inner tungsten-halogen lamp being mounted approximately at the focal point of the reflector member, and (c) a flexible electrically conductive vibration damping element physically joining each protruding lead wire to terminal means. The tungsten-halogen lamp has an elongated sealed envelope of light transmissive material terminating at opposite ends in a seal region from which protrudes a refractory metal lead wire. The lamp is physically supported within the reflector member by said lead wires. Each vibration damping element has a planar body portion which is physically joined to the lamp envelope at a seal region while also electrically connecting the lead wire and terminal means which are physically joined together. As hereinbefore indicated, a variety of reflector lamp unit constructions employing such inner lamp mount improvement are contemplated with respect to both reflector member and inner lamp embodiments. For example, suitable concave reflectors can have both parabolic as well as elliptical contours and can be formed with glass material generally having an internal reflecting surface or coating. The reflector lamp unit can further be provided with a cover member of light transmissive material being secured or sealed to the upper or front portion of the reflector member and with the cover member further including lens elements, all as commonly now employed in conventional lamp unit constructions of this type. Similarly, the inner lamp envelope can be provided with an infrared reflecting film as taught in the aforementioned U.S. Pat. No. 4,810,932.

An inner lamp having the double ended configuration further described in the U.S. Pat. No. 4,810,932 can be employed in connection with the present improvement and whereby the seal regions found at both ends of said lamp envelope are provided in tubular neck portions. More particularly, the present vibration damping elements can be physically secured to each tubular neck portion of the disclosed lamp envelope with the filament lead wires projecting from said tubular neck portions further being electrically connected thereto. Various lamp filament constructions are likewise contemplated for the inner tungsten-halogen lamp component of an improved reflector lamp unit construction according to the present invention. A primary or single coil configuration generally satisfies low voltage type lamp applications, whereas, a coiled-coil type lamp filament is generally employed for lamp operation at ordinary domestic and foreign operating voltages. The inner lamp component is customarily mounted within the reflector member at its focal point with filament alignment being substantially along the central or longitudinal lamp unit axis as well as being substantially transverse thereto. Employment of the present lamp mount improvement further enables the vibration damping elements incorporated therein to serve as reference planes for accurate filament location in the reflector lamp unit.

A representative sealed beam type headlamp unit having the present lamp mount construction comprises: (a) an outer parabolic glass reflector member coated with an inner reflecting surface and having stiff post terminals projecting from the rear base portion thereof, (b) an inner tungsten-halogen lamp being mounted approximately at the focal point of the reflector member, and (c) a flexible electrically conductive vibration damping element physically joining protruding lead wires to a post terminal. The reflector member is sealed at its front portion to a glass lens member. The tungsten-halogen lamp has an elongated sealed envelope of light transmissive material terminating at opposite ends in a tubular shaped neck seal portion from which protrudes a refractory metal lead wire. The lamp is physically supported within the reflector member by the lead wires while being aligned along the longitudinal lamp unit axis. The lamp envelope containing an inert gas fill further includes a vaporizable halogen substance and has a tungsten filament suspended therein by the lead wires so as to extend along the longitudinal lamp unit axis. Each vibration damping element is formed with an electrically conductive thermally durable and spring-like sheet metal to include a planar body portion having a plurality of projecting support tabs extending therefrom which physically grip the tubular neck portion of the lamp envelope. The damping element further includes another projecting tab for electrical connection to the lead wire protruding from said neck portion. The front one of the vibration damping elements has a body portion further shaped to furnish light shielding means in the lamp unit. Both reflector and cover members for the herein illustrated lamp unit construction can be formed by customary molding or press procedures. Likewise, conventional exhaust tube means and metal ferrules can be included as component parts of a suitable reflector member.

BRIEF DESCRIPTION OF THE DRAWINGS

FIG. 1 is a perspective view partially in cross section for a representative sealed beam headlamp unit embodying the improved inner mount construction of the present invention.

FIG. 2 is an enlarged plan view depicting the rear vibration damping element being utilized in the FIG. 1 headlamp construction.

DETAILED DESCRIPTION OF THE PREFERRED EMBODIMENTS

Figure 3:
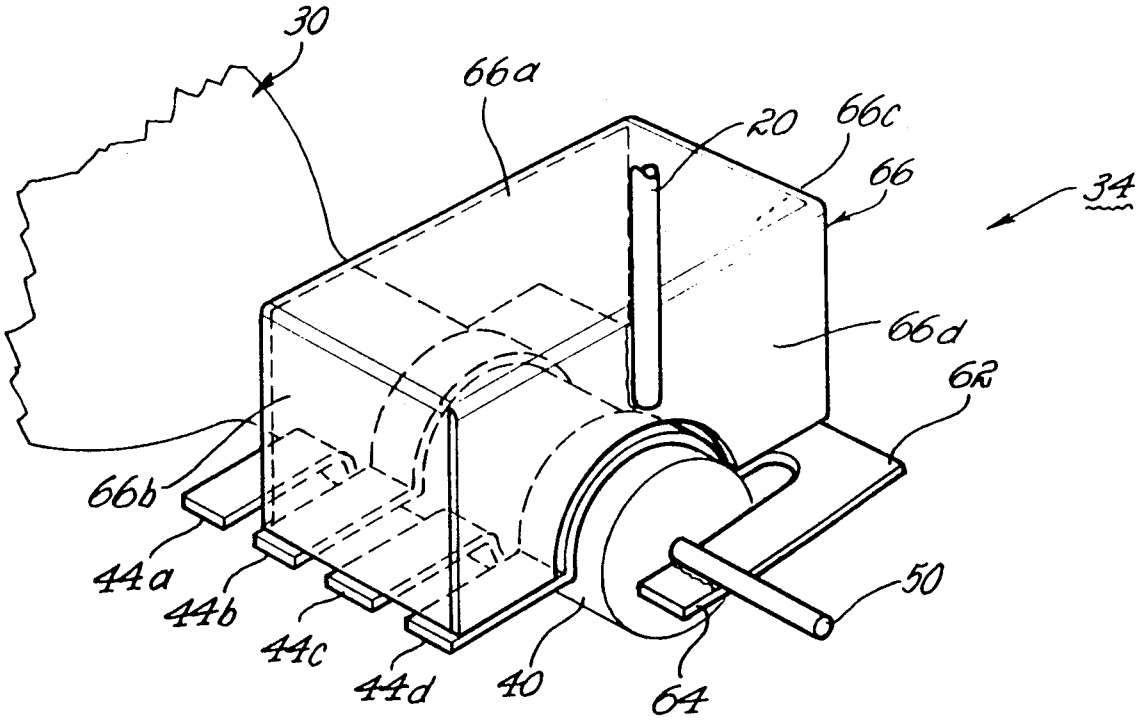
FIG. 3 is an enlarged perspective view depicting the front vibration damping element being utilized in the FIG. 1 headlamp construction.

Referring to the drawings, there is depicted in FIG. 1 an improved sealed beam headlamp unit 10 having a concave parabolic or elliptical reflector member 12 sealed to a cover member 14. Reflector 12 has an internal reflecting surface 16 which may be typically a silver, aluminum or dichroic type and a bottom portion 18 from which projects upwardly a pair of rod-like post members 20 and 22. Terminal ends of these post members are joined to customary ferrules 24 and 26 sealed into the reflector base to provide rigid terminal means in the lamp unit. A conventional exhaust tube 28 also sealed at the base of reflector 12 enables evacuation of the assembled lamp unit during its manufacture.

A tungsten-halogen lamp 30 serving as a light source for headlamp 10 is physically joined to the inner ends of post member 20 and 22 with vibration damping elements 32 and 34, respectively, which are also physically joined to opposite ends of the lamp envelope 36. A conventional infrared reflecting film 52 may be further coated on the outer surface of the depicted lamp envelope 36 which further contains a gaseous fill that include at least one rare gas along with a vaporizable halogen substance such as an alkyl halide. The depicted lamp envelope 36 includes oppositely disposed tubular neck portions 38 and 40 which are physically gripped with finger-like projections 42 and 44, respectively, formed in each of the said vibration damping elements. A tungsten filament coil 46 is suspended within the lamp envelope by refractory metal lead wires 48 and 50 which are hermetically sealed in the tubular neck portions of the lamp envelope and protrude outwardly from the ends of the tubular neck portions as can be seen in the drawing. As can also be seen in the drawing, the terminal ends of the protruding lead wires 48 and 50 are physically joined to the vibration damping elements 32 and 34, respectively, which further enables electrical connection of the lamp filament 46 to a power source for the lamp unit. The defined physical and electrical characteristics for the lamp unit being illustrated are achieved by forming both of the vibration damping elements with an electrically conductive thermally durable and spring-like sheet metal such as stainless steel or spring bronze, and which have been further shaped to provide the means for physical joinder to the lamp envelope. A box-like shaped light shield 54 has been provided on the front vibration damping element 34 with the construction of both of the vibration damping elements to be further described in connection with the FIGS. 2-3 drawings thereupon. As further evident in FIG. 1, however, it can be noted that the tungsten-halogen lamp 30 is positioned substantially at the optical focal point of reflector member 12 with the lamp further being oriented along the central or longitudinal axis of the lamp unit. The envelope 36 of lamp 30 may in one embodiment be formed of a quartz material and have foil sealing members and in another embodiment be formed of a glass material having rod like inleads that are devoid of foil members. A suitable method for manufacture of the tungsten-halogen lamp 30 being employed in the present lamp unit embodiment can be found in the above referenced U.S. Pat. No. 4,810,932 to include hermetic sealing of the tungsten filament coil assembly within the lamp envelope with thin refractory metal foil elements.

FIG. 2 represents an enlarged plan view for the rear vibration damping element 32 being employed in the FIG. 1 lamp unit. As therein depicted, the element includes a planar body portion 56 of electrically conductive thermally durable and spring-like sheet metal provided with support tab protections 42*a*, 42*b*, 42*c* and 42*d* along with a further electrical terminal tab 58. The support tab projections can be formed to have a semicircular contour 60 sized to accommodate a spring-like gripping action about the circumference of the lamp envelope neck portion 38 while remaining electrical tab 58 furnishes the location for physical and electrical connection of protruding lamp filament lead wire 48 thereto. Post member 22 is also physically and electrically connected to the main body portion of the element as shown in FIG. 2. Permanent joinder of both lead wire and post member to the vibration damping element can be carried out by conventional means such as welding, brazing and the like.

In quartz-halogen lamps such as lamp 30, the seal between the electrical feed through 48 and the quartz envelope 36 is made by trapping thin tabs or foils 70 of molybdenum in the quartz seal. Attached to one end of these tabs are the lead wires (not shown) which make the electrical attachment to filament 46; on the other end, the coil legs or coil mount wires such as 48 which are attached to foil. For this seal to work the edges of the molybdenum (moly) foils 70 are preferred to be feathered in order to facilitate the moly bonding to the quartz material of the envelope 42 over the foil 70 entire circumference of foil 70. At the point at which the moly foil is attached to the external lead wires the seal may be fragile. We have found that the seal around the external lead wires may not really be a seal in the hermetic sense, (i.e. glass chemically bonded to metallic oxides), but more of a mechanical seal. Air, bearing oxygen, can migrate along these lead wire "seals". The speed at which oxygen migrates is temperature dependent. Also temperature dependent is the effect of oxygen on the moly foil. At higher temperatures, above 350° C., moly oxidation is so rapid that long lamp design lives are difficult to maintain.

When quartz-halogen lamps are used in conventional sealed beam lamps the internal atmosphere can be made free of oxygen. The fill gas used on most inner bulb sealed beam lamps is 100% nitrogen. This effectively prevents oxygen attack of the moly foils and allows very high seal temperatures. In other types of lamps such hermetic enclosure is not possible. Other lamps may be limited, in certain fixtures, to power levels below 75 atts so as to avoid the moly foil problems. In an effort to improve the sealing performance related to moly seals, various "sealant" materials have been used to protect the moly. These sealants have several basic problems which limit their use; (1) some sealants have relatively high vapor pressures and boil-off or sublime at the elevated seal temperatures; (2) other sealant materials, in their solid state, exhibit higher expansion coefficients than quartz envelope and may actually "pry" open the quartz envelope around the lead wires which allows more oxygen migration and more rapid corrosion; and (3) still other materials have chemical properties which are detrimental to the electrical characteristics of other parts of the lamp such as the lead wires.

The present invention in one of its aspects maintains a cooler seal temperature of the moly foils as its solution. The present invention uses a ceramic material to keep the seal area of the lamp 30 cooler than would otherwise be provided. In the present invention, contrary to what one would commonly expect of ceramic materials, the ceramic cement actually conducts heat away from the seal area to which it is attached, faster than this heat would be removed were the ceramic not there at all. We have performed analysis that revealed that the conductivity of quartz and ceramics is higher than that of air, one of the best insulators. A stagnant film of air such as that formed by the present invention insulates the lamp 30 and allows heat to pass to the moly seals only through conduction. Forced or free convection cannot occur due to the small spaces available for such convection. Where the cement is in close proximity to the quartz, this insulating air film is minimized or absent and the heat flux increases in an inverse relationship to the film thickness. The heat thus removed is transferred to other parts of the lamp such as the reflector or lead wires which act as heat sinks and radiators.

In the lamp 30 of FIGS. 1–3, the tabs members 42*a* . . . 44*d* have their area and surface appropriately modified to facilitate radiative and convective heat transport. This modification may include convolution of the tabs so as to increase surface area and blackening of the surface of the tabs to enhance radiation mechanisms. Heat transfer from the quartz seal is facilitated by part the ceramic material in contact with the surface of the tabs, an appropriately broadened dimension in the area of the moly foil. In order to overcome the point contact between the tabs and the lamp envelope 26 that invariably occurs in a spring clamp arrangement of this type, a thin layer of ceramic cement is preferably applied under the clamp between the tab and the quartz envelope. This is preferably done before the members are placed over the quartz envelope. It is not necessary that this ceramic cement rigidly hold the quartz envelope and tab fingers 42*a* . . . 44*d* together; only that the cement reduce the stagnant air layer between the envelope and the tabs to negligible proportions. The ceramic cement reduces the temperature at the regions of the foils 70 and thereby improves the sealing of such foils.

In FIG. 3 there is shown an enlarged perspective view of the front vibration damping element 34 being utilized in the FIG. 1 lamp unit for vibration retarding purposes. This element includes a main body portion 62 having support tabs 44*a*, 44*b*, 44*c* and 44*d* projecting therefrom while a remaining tab projection 64 has filament lead wire 50 connected thereto. Again, the support tabs are formed to enable gripping action about the neck portion 40 of the lamp envelope and post member 20 is again secured to the main body portion of the element. There is further included a box-like light shield 66 projecting upwardly from the main body portion of the element 34 and which may be formed with still other tab portions provided in the main body by a conventional stamping operation and the like. As can be seen in FIG. 3, the box-like projection includes a top surface 66*a*, side surfaces 66*b* and 66*c* and a front surface 66*d* all configured so as to block and absorb undesired forward light emergence from the lamp unit.

It will be apparent from the foregoing description that a generally improved mount construction to support a double ended tungsten-halogen lamp in various type reflector lamp units has been provided which better resists mechanical vibration environments. Further, the present invention provides a ceramic cement that enhances and increases the sealing arrangement of the foil members related to a quartz lamp 30. It is contemplated that modifications can be made in the specific lamp embodiments herein illustrated, however, without departing from the spirit and scope of the present invention. For example, still other know concave reflector member shapes can be employed to include having both an elliptical and spherical section as well as having a multifaceted reflecting surface to cooperate optically with the light source of the lamp unit. Similarly, other known sealed beam headlamp units employ a rectangular glass reflector member wherein a parabolic reflecting surface has been truncated on opposite sides by parallel planar surfaces. The present tungsten-halogen lamp construction can also employ various tungsten filaments, sized and shaped depending upon the wattage and voltage requirements of the intended lamp unit application with still other filament lead wire configurations being employed to suspend the filament within the lamp envelope. Additionally, it is still further contemplated to have the reflector member sealed to mating cover means by adhesive sealing as well as fusion sealed. Variations in the physical configuration of the disclosed vibration damping elements are also contemplated. Thus, additional rigidity can be imparted to these elements such as by cross section embossment or forming of the elements with an angular cross section. Providing an additional tab projection to each of the disclosed vibration damping elements might further eliminate any need for the post members 20 and 22 now being employed in the illustrated headlamp construction. Consequently, it is intended to limit the presently claimed invention only by the scope of the appended claims.

What we claim as new and desire to secure by Letters Patent of the United State is:

1. A double ended type incandescent light source having a vibration resistant mount means within a reflector lamp unit comprising:

(a) a tungsten-halogen lamp having an elongated sealed envelope of light transmissive material terminating at opposite ends in a seal region from which protrudes a refractory metal lead wire, the lamp being physically supported within the lamp unit by said lead wires;

(b) a flexible electrically conductive vibration damping element physically joining each protruding lead wire to a rigid terminal means provided in the lamp unit, each vibration damping element having a planar body portion which is physically joined to the lamp envelope at a seal region while electrically connecting the lead wire and terminal being physically joined together; and (c) wherein said vibration damping elements each comprises electrically conductive spring like metal having a plurality of projecting tabs formed thereon, said plurality of projecting tabs contacting and at least partially surrounding said respective seal regions of said lamp envelope, and further wherein at least one of said projecting tabs of each of said vibration damping elements enables electrical connection to the lead wire protruding from said respective seal regions and simultaneously contacts an end face portion of said respective seal regions so as to provide support against lateral movement of said lamp.

2. The mount means of claim 1 further comprising a thin layer of ceramic cement interposed between the vibration damping element and the seal region of the lamp envelope.

3. The mount means of claim 1 wherein the seal regions are formed in tubular neck portions of the lamp envelope and the vibration damping elements are physically secured to the tubular neck portions.

4. The mount means of claim 1 wherein the tungsten-halogen lamp includes a tungsten filament coil sealed within the lamp envelope by sealing to thin refractory metal foil elements.

5. The mount means of claim 1 wherein one of the vibration damping elements is formed in a shape enabling the body portion to furnish light shielding means.

6. A reflector lamp unit comprising:

(a) an outer concave reflector member having rigid terminal means located at a base portion thereof, said reflector member further having a focal point associated therewith;

(b) an inner tungsten-halogen lamp being mounted approximately at the focal point of the reflector member, the tungsten-halogen lamp having an elongated sealed envelope of light transmissive material terminating at opposite ends in a seal region from which protrudes a refractory metal lead wire, the lamp being physically supported within the reflector member by said lead wires, (c) a flexible electrically conductive vibration damping element physically joining each protruding lead wire to the terminal means, each vibration damping element having a planar body portion which is physically joined to the lamp envelope at a seal region while also electrically connecting the lead wire and terminal being physically joined together, and (d) wherein said vibration damping elements each comprises electrically conductive spring like metal having a plurality of projecting tabs formed thereon, said plurality of projecting tabs contacting and at least partially surrounding said respective seal regions of said lamp envelope, and further wherein at least one of said projecting tabs of each of said vibration damping elements enables electrical connection to the lead wire protruding from said respective seal regions and simultaneously contacts an end face portion of said respective seal regions so as to provide support against lateral movement of said lamp.

7. The lamp unit of claim 6 further comprising a thin layer of ceramic cement interposed between the vibration damping element and the seal region of the envelope.

8. The lamp unit of claim 6 wherein the refractory member includes a light reflective inner surface.

9. The lamp unit of claim 6 wherein the lamp envelope includes an infrared reflecting film.

10. The lamp unit of claim 6 wherein the reflecting member is sealed to cover means of light transmissive material.

11. The lamp unit of claim 10 wherein the cover means includes lens elements.

12. The lamp unit of claim 6 wherein the tungsten-halogen lamp includes an axially aligned tungsten filament coiled sealed within the lamp envelope.

13. The lamp unit of claim 6 wherein one of the vibration damping elements is shaped to furnish light shielding means.

14. The lamp unit of claim 6 wherein the seal regions are formed in tubular neck portions of the lamp envelope and the vibration damping elements are physically secured to the tubular neck portions.

15. A sealed beam headlamp unit comprising:

(a) an outer parabolic glass reflector member coated with an inner reflecting surface and having stiff post terminals located at a rear base portion of said reflector member, the reflector member further having a front portion sealed to a glass lens member, said reflector member further having a focal point associated therewith, (b) an inner tungsten-halogen lamp being mounted approximately at the focal point of the reflector member, the tungsten-halogen lamp having an elongated sealed envelope of light transmissive material terminating at opposite ends in a tubular neck shaped seal portion from which protrudes a refractory metal lead wire, the lamp being physically supported within the reflector member by said lead wires while being aligned along the longitudinal lamp unit axis, the lamp envelope containing an inert gas fill which further includes a vaporizable halogen substance and having a tungsten filament suspended therein by the lead wires so as to extend along said longitudinal lamp unit axis;

(c) a flexible electrically conductive vibration damping element physically joining each protruding lead wire to a post terminal, each vibration damping element being formed with electrically conductive thermally durable an spring-like sheet metal to include a planar body portion having a plurality of projecting support tabs extending therefrom which physically grip the tubular neck portion of the lamp envelope and the front one of said vibration damping elements having the body portion further shaped to furnish light shielding means to the lamp unit; and (d) wherein at least one of said projecting support tabs of each of said vibration damping elements enables electrical connection to the lead wire protruding from said respective seal regions and simultaneously contacts and end face portion of said respective seal regions so as to provide support against lateral movement of said lamp.

16. A sealed beam headlamp unit according to claim 15 further comprising a thin layer of ceramic cement interposed between the support tabs and the tubular neck portions.

* * * * *